US007805931B2

(12) United States Patent
Carlill

(10) Patent No.: US 7,805,931 B2
(45) Date of Patent: Oct. 5, 2010

(54) SELF-SUSTAINING OXY-EXOTHERMAL FILTER REGENERATION SYSTEM

(75) Inventor: Thomas W. Carlill, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 243 days.

(21) Appl. No.: 11/589,044

(22) Filed: Oct. 30, 2006

(65) Prior Publication Data

US 2008/0098723 A1 May 1, 2008

(51) Int. Cl.
*F01N 3/00* (2006.01)

(52) U.S. Cl. ..... 60/295; 60/274; 60/287; 60/289; 60/297; 60/303; 123/568.11

(58) Field of Classification Search ..... 60/274, 60/287, 288, 289, 295, 297, 303, 311; 123/568.11, 123/568.17, 568.25
See application file for complete search history.

(56) References Cited

U.S. PATENT DOCUMENTS

| | | | | |
|---|---|---|---|---|
| 5,775,099 | A * | 7/1998 | Ito et al. | 60/274 |
| 6,427,436 | B1 * | 8/2002 | Allansson et al. | 60/274 |
| 6,560,959 | B2 * | 5/2003 | Katsuta et al. | 60/284 |
| 6,681,567 | B2 * | 1/2004 | Yasui et al. | 60/297 |
| 6,742,335 | B2 * | 6/2004 | Beck et al. | 60/605.2 |
| 6,823,663 | B2 | 11/2004 | Hammerle et al. | |
| 6,832,473 | B2 | 12/2004 | Kupe et al. | |
| 6,871,489 | B2 | 3/2005 | Tumati et al. | |
| 6,925,992 | B1 * | 8/2005 | Eriksson et al. | 123/568.12 |
| 7,189,374 | B1 * | 3/2007 | Hawker | 422/168 |
| 2004/0098979 | A1 | 5/2004 | Hammerle et al. | |
| 2004/0226288 | A1 | 11/2004 | Okugawa et al. | |
| 2005/0198945 | A1 | 9/2005 | Okugawa et al. | |
| 2005/0223699 | A1 | 10/2005 | Ancimer et al. | |
| 2005/0241301 | A1 | 11/2005 | Okugawa et al. | |
| 2006/0150628 | A1 | 7/2006 | Bolton et al. | |
| 2006/0179824 | A1 | 8/2006 | Roser | |
| 2006/0218897 | A1 | 10/2006 | Sisken et al. | |

FOREIGN PATENT DOCUMENTS

| | | |
|---|---|---|
| EP | 1217196 | 6/2002 |
| EP | 1645731 | 4/2006 |
| JP | 2005 320880 | 11/2005 |

* cited by examiner

*Primary Examiner*—Tu M Nguyen
(74) *Attorney, Agent, or Firm*—Finnegan, Henderson, Farabow, Garrett & Dunner LLC

(57) ABSTRACT

An exhaust-treatment system is provided having an oxidation catalyst configured to heat exhaust gas flowing through the oxidation catalyst. The system also has a particulate filter configured to receive the heated exhaust gas, and a recirculation loop configured to receive a portion of heated exhaust gas downstream of the oxidation catalyst and deliver the portion of exhaust gas upstream of the oxidation catalyst.

18 Claims, 3 Drawing Sheets

SELF-SUSTAINING OXY-EXOTHERMAL FILTER REGENERATION SYSTEM

TECHNICAL FIELD

This disclosure relates generally to a filter regeneration system, and more particularly, to a self-sustaining oxy-exothermal filter regeneration system.

BACKGROUND

Internal combustion engines can be configured to operate using a variety of fuels, including diesel, gasoline, natural gas, ethanol, and other suitable fuel types. While fuel combustion converts some chemical energy into mechanical energy, the fuel combustion process is usually sub-optimal and typically produces a complex mixture of pollutants. These emissions often include solid material and undesirable gaseous compounds, such as, carbon-based particulate matter, nitrogen oxides, and sulfur compounds. In response to heightened environmental concerns, regulatory agencies have increased the stringency of emission standards for such engines, forcing engine manufactures to develop systems to further reduce engine emissions.

One method used by engine manufacturers to reduce engine emissions includes the use of particulate filters configured to capture particulate matter produced by the combustion reaction. However, over time the particulate filter may become clogged with particulate matter and may require cleaning through a regeneration process, wherein particulate matter is purged from the filter. Filter regeneration can be achieved using several techniques, such as, for example, reversing gas flow through the filter, removing the filter for a manual cleaning, or raising filter temperature to burn off accumulated particulate matter. The "burn off" process offers a relatively simple and practical solution that includes igniting and burning trapped carbon to form carbon dioxide and/or carbon mono-oxide that can then pass through the filter in gaseous form.

Several strategies can be used to raise filter temperature during a regeneration process. Ideally, the filter temperature and oxygen concentration of the exhaust gas should be sufficient to ignite the carbon matter and continue the burn to completion. Such exhaust gas conditions may be achieved using engine management systems to regulate the combustion process, heating coils located in the exhaust system, or microwave energy applied to the filter.

Filter regeneration can also be achieved using an oxidation catalyst positioned in an exhaust flow upstream of the filter, and configured to raise exhaust temperature to oxidize trapped particulate matter. During regeneration, the oxidation catalyst may operate in conjunction with a fuel supply, wherein the fuel supply provides fuel to the catalyst. The catalyst oxidizes the fuel via an exothermic reaction that increases exhaust temperature. In order to maintain the exothermic reaction, the catalyst material should be maintained at temperatures above a "light-off" temperature, the temperature at which catalyst materials can spontaneously oxidize hydrocarbons. Such light-off temperatures are about 250° C.

One filter regeneration system that includes an oxidation catalyst is described in U.S. Patent Application Publication No. 2005/0241301 (hereinafter "the '301 publication") of Okugawa et al., published on Nov. 3, 2005. The '301 publication describes an exhaust cleaning system that includes a particulate filter and an oxidation catalyst positioned upstream of the particulate filter. The exhaust temperature can be increased by providing excess hydrocarbons to the exhaust gas and oxidizing the hydrocarbons via an exothermic reaction within the oxidation catalyst to heat and regenerate the particulate filter.

Although the regeneration system of the '301 publication may regenerate the particulate filter, the system includes various sensors and an electronic control unit (ECU) configured to adjust engine performance. The ECU monitors the filter temperature and adjusts various engine operating parameters, such as, air-to-fuel ratio and valve-timing, to periodically modify the combustion process to raise the exhaust temperature, and hence regenerate the filter. Such a system may increase the cost and complexity of a regeneration system, and increase the fuel consumption by operating an engine at less than optimal conditions.

The present disclosure is directed at overcoming one or more of the limitations in the prior art.

SUMMARY OF THE INVENTION

One aspect of the present disclosure includes an exhaust-treatment system, including an oxidation catalyst configured to heat exhaust gas flowing through the oxidation catalyst. The system also includes a particulate filter configured to receive the heated exhaust gas, and a recirculation loop configured to receive a portion of heated exhaust gas downstream of the oxidation catalyst and deliver the portion of exhaust gas upstream of the oxidation catalyst.

A second aspect of the present disclosure includes a machine having a power source configured to produce exhaust gas. The machine also includes an exhaust-treatment system having an oxidation catalyst configured to heat exhaust gas flowing through the oxidation catalyst. The exhaust-treatment system also includes a particulate filter configured to receive the heated exhaust gas, and a recirculation loop configured to receive a portion of heated exhaust gas downstream of the oxidation catalyst and deliver the portion of exhaust gas upstream of the oxidation catalyst.

A third aspect of the present disclosure includes a method of regenerating a particulate filter, wherein the method includes passing a flow of exhaust gas through an oxidation catalyst. The method also includes directing a portion of the exhaust gas downstream of the oxidation catalyst into the exhaust gas upstream of the oxidation catalyst via a recirculation loop to at least partially heat the exhaust gas, and regenerating a particulate filter by passing the heated exhaust gas through the particulate filter.

BRIEF DESCRIPTION OF THE DRAWINGS

The accompanying drawings, which are incorporated in and constitute a part of this specification, illustrate exemplary embodiments of the disclosure and, together with the written description, serve to explain the principles of the disclosed system.

DETAILED DESCRIPTION

Figure 1:
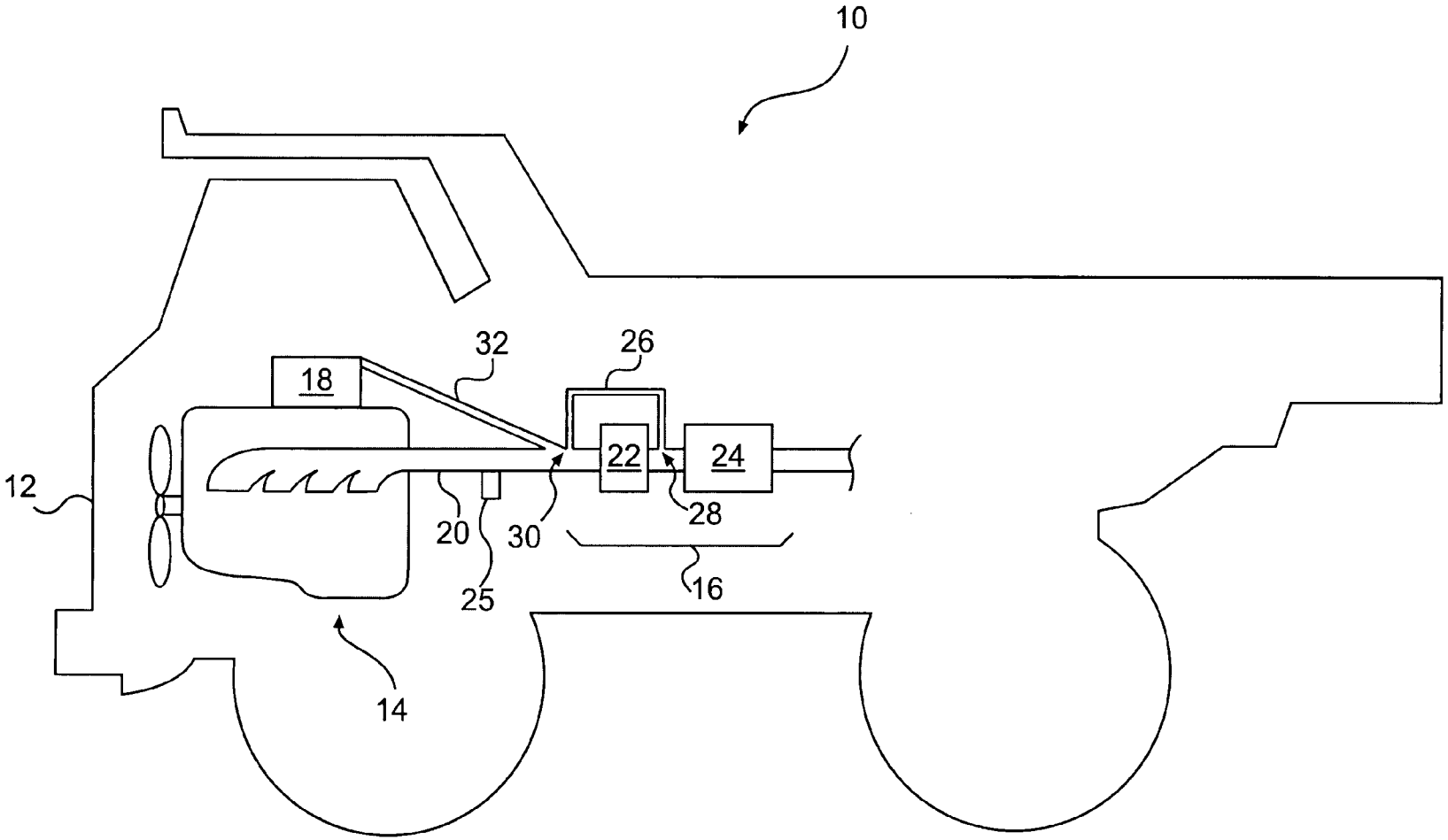
FIG. 1 is a diagrammatic illustration of a machine, according to an exemplary disclosed embodiment.

FIG. 1 illustrates a machine 10 including a frame 12, a power source 14, and an exhaust-treatment system 16.

Although machine 10 is shown as a truck, machine 10 could be any type of mobile or stationary machine having any suitable type of power source 14. Power source 14 may be configured to provide power to an on-highway vehicle, construction or mining equipment, or a factory or power plant. In addition, power source 14 may be mounted on frame 12, and may include any suitable type of engine, such as, for example, an internal combustion engine. In some embodiments, power source 14 may include a diesel engine, a gasoline engine, a gaseous fuel-powered engine, or any other engine known in the art. Further, power source 14 may produce exhaust gases that can be treated using an exhaust-treatment system 16.

Power source 14 may include a plurality of combustion chambers (not shown), wherein each combustion chamber can be configured to permit fuel combustion. Each combustion chamber can be supplied with air via an intake manifold 18. Intake manifold 18 may be configured to receive atmospheric air and supply air to one or more combustion chambers of power source 14. In some embodiments, intake manifold 18 can be operably associated with a forced-induction system (not shown).

Forced-induction systems may include turbochargers or superchargers. The turbocharger may utilize a flow of exhaust gas from a combustion chamber of power source 14 to generate power for a compressor (not shown), while the supercharger may operate the compressor via a belt coupled to a crank-shaft of power source 14. The compressor may include a fixed geometry type compressor, a variable geometry type compressor, or any other type of compressor known in the art. The compressor may provide additional air to power source 14 to increase air pressure and power output produced by power source 14.

Power source 14 may also include one or more exhaust passages 20 that are fluidly connected to a combustion chamber and configured to permit exhaust gas to exit the combustion chamber. Exhaust passage 20 can include any suitable conduit configured to permit exhaust gas to flow from power source 14 to the atmosphere. To reduce exhaust gas emissions, exhaust passage 20 can be fluidly connected to exhaust-treatment system 16.

Exhaust-treatment system 16 can be configured to at least partially remove various combustion products contained within exhaust gas. In particular, exhaust-treatment system 16 can include one or more devices and/or systems disposed within a flow of exhaust gas produced by power source 14. These various devices and/or systems can be configured to remove unwanted gases and/or particulate matter from the exhaust gas. For example, exhaust-treatment system 16 can include a catalyst 22 and/or a filter 24. In some embodiments, catalyst 22 and/or particulate filter 24 may be fluidly connected to exhaust passage 20 and disposed within a flow of exhaust gas.

Catalyst 22 can include any suitable catalytic material configured to convert one or more constituents of the exhaust gas into a more environmentally acceptable gas and/or compound to be discharged into the atmosphere. Conversion of various harmful constituents can occur via any suitable chemical reaction, such as, for example, oxidation or reduction. For example, catalytic material may be configured to chemically alter at least one component of the exhaust flow, wherein catalyst 22 can remove pollutants such as hydrocarbons and/or carbon monoxide from the exhaust gas.

Catalyst 22 can be configured to facilitate various reactions, such as, for example, selective catalytic reduction (SCR), or adsorption of nitrous oxides (NOx; e.g., a NOx absorber). Catalyst 22 can also include an oxidation catalyst, such as, for example, a diesel oxidation catalyst (DOC). The oxidation catalyst can convert hydrocarbons, carbon monoxide and/or nitrous oxide into less noxious products. Such a catalyst may include any suitable catalytic material, such as, for example, platinum, aluminum, palladium, rhodium, barium, cerium, alkali metals, alkaline-earth metals, rare-earth metals, or combinations thereof.

Particulate filter 24 can include a variety of designs, materials, and/or structures configured to capture particulate matter by physical filtration. Specifically, particulate filter 24 can include any type of trap or similar device configured to retain various solid combustion products produced by power source 14, such as, soot, ash, and/or unburned hydrocarbons. For example, particulate filter 24 can include a diesel particulate filter (DPF), wherein the DPF can include a ceramic honeycomb monolith. Particulate filter 24 can also include a partial filter designed to trap, for example, about 60% of particulate matter.

Particulate filter 24 can include a filter medium configured to trap particulate matter contained in the exhaust gas. The filter medium may include a mesh-like material, a porous ceramic material, fiber mats, or any other material and/or configuration suitable for trapping particulate matter. Particulate filter 24 can be manufactured from a variety of materials including cordierite, silicon carbide, and other high temperature oxide ceramics.

In some embodiments, exhaust-treatment system 16 can include a combination device containing features of catalyst 22 and filter 24. For example, such a combination device may include one or more catalytic particulate filters (not shown), which may include a catalytic material integral with filter medium. Specifically, catalyst 22 may be packaged with, coated on, or otherwise associated with the medium of filter 24 such that the filter medium may be formed from a catalytic material. In addition, although exhaust-treatment system 16 is shown with a single catalyst 22 and a single particulate filter 24, system 16 may include more than one of either or both. Further, exhaust-treatment system 16 may include multiple catalytic particulate filters.

As previously described, particulate filter 24 may require periodic regeneration to remove accumulated particulate matter. Regeneration can be achieved by raising the temperature of particulate filter 24 to "burn off" or oxidize some of the accumulated particulate matter. As discussed below, an oxidation catalyst positioned upstream of particular filter 24 can be used to raise the exhaust temperature sufficiently to remove trapped particulate matter from filter 24.

In some embodiments, fuel can be introduced into the exhaust gas upstream of the oxidation catalyst to raise the exhaust temperature via an oxidation reaction. For example, a fuel supply 25 can be fluidly connected to exhaust passage 20 and configured to supply fuel to the exhaust gas. Fuel supply 25 and/or exhaust passage 20 can include various components and/or systems configured to sufficiently mix the fuel (e.g. various hydrocarbons) with the exhaust gas to provide a generally even distribution of fuel-containing exhaust gas flow into catalyst 22. The hydrocarbons can then react with the catalytic material to produce an exothermal reaction. This exothermic reaction can heat the exhaust gas via energy released during hydrocarbon reduction. Such an exothermic reaction can raise exhaust gas temperatures to regenerate filter 24 located downstream of catalyst 22.

In order to regenerate filter 24, fuel can react with the oxidation catalyst material to heat the exhaust gas. However, this oxy-exothermal reaction should be conducted when the temperature of catalyst 22 is above a "light-off" temperature, or temperature at which the catalyst material is hot enough to permit a self-sustaining oxy-exothermal reaction. To achieve such a reaction, exhaust gas may be recirculated from downstream of catalyst 22 to upstream of catalyst 22. Exhaust gas downstream of catalyst 22 can be hotter than exhaust gas upstream of catalyst 22. Therefore, recirculated exhaust gas could be used to maintain the catalyst temperature above the light-off temperature, thus permitting a self-sustaining oxy-exothermal reaction. Heat generated by such a self-sustained reaction may be used to raise exhaust gas temperatures downstream of catalyst 22 to permit regeneration of particulate filter 24.

Exhaust-treatment system 16 can include a recirculation loop 26. Recirculation loop 26 can be configured to receive a portion of exhaust gas downstream of catalyst 22 and deliver the portion of exhaust gas upstream of catalyst 22, to permit that exhaust gas to be recirculated through catalyst 22 a second time. This exhaust gas recirculation may function to raise the temperature of exhaust gas flowing into catalyst 22. In some embodiments, the flow of recirculated exhaust gas can be sufficient to maintain the temperature of an oxidation catalyst above the light-off temperature.

Recirculation loop 26 can include one or more passages configured to permit a portion of exhaust gas to flow from a location downstream of catalyst 22 to a location upstream of catalyst device 22. To permit exhaust gas recirculation through catalyst 22, recirculation loop 26 may be fluidly connected to exhaust passage 20 downstream of catalyst 22. Specifically, recirculation loop 26 can include an input aperture 28 configured to receive a portion of exhaust gas flow downstream of catalyst 22. Input aperture 28 may be dimensioned and configured to allow some exhaust gas to flow from exhaust passage 20 into recirculation loop 26.

Recirculation loop 26 may also be fluidly connected to exhaust passage 20 upstream of catalyst 22. Recirculation loop 26 can include an exit aperture 30 configured to deliver exhaust gas flowing through recirculation loop 26 to a location upstream of catalyst 22. Exit aperture 30 may be dimensioned and configured to permit exhaust gas recirculated through recirculation loop 26 to flow from recirculation loop 26 into exhaust passage 20. Input aperture 28 and exit aperture 30 may be fluidly connected such that a portion of recirculated exhaust gas may flow into input aperture 28 and may flow into the exhaust gas upstream of catalyst 22 via exit aperture 30.

Recirculation loop 26 may be configured to recirculate exhaust gas through catalyst 22 using various methods, devices and/or systems. In some embodiments, a pressure drop between input aperture 28 and exit aperture 30 may permit exhaust gas to flow from input aperture 28 to exit aperture 30. For example, a pressure drop of about 1-2 kPa may permit sufficient flow of exhaust gas through recirculation loop 26.

In some embodiments, a pressure drop across recirculation loop 26 may be at least partially provided by an air-line 32. Air-line 32 can include any suitable conduit configured to provide fluid flow to exhaust passage 20 and/or recirculation loop 26. For example, as shown in FIG. 1, air-line 32 can be fluidly connected to intake manifold 18 such that atmospheric air can be supplied to recirculation loop 26 and/or exhaust passage 20. Atmospheric air provided by air-line 32 may provide a pressure drop in the vicinity of exit aperture 30, as described below and shown in FIG. 2. In other embodiments, air-line 32 can be fluidly connected to any suitable location of exhaust passage 20 such that exhaust gas can provide a pressure drop in the vicinity of exit aperture 30. For example, air-line (not shown) could be fluidly connected to exhaust passage 20 downstream of filter 24 such that exhaust gas downstream of filter 24 may flow into exhaust gas upstream of catalyst 22 to provide a pressure drop in the vicinity of exit aperture 30.

Figure 2:
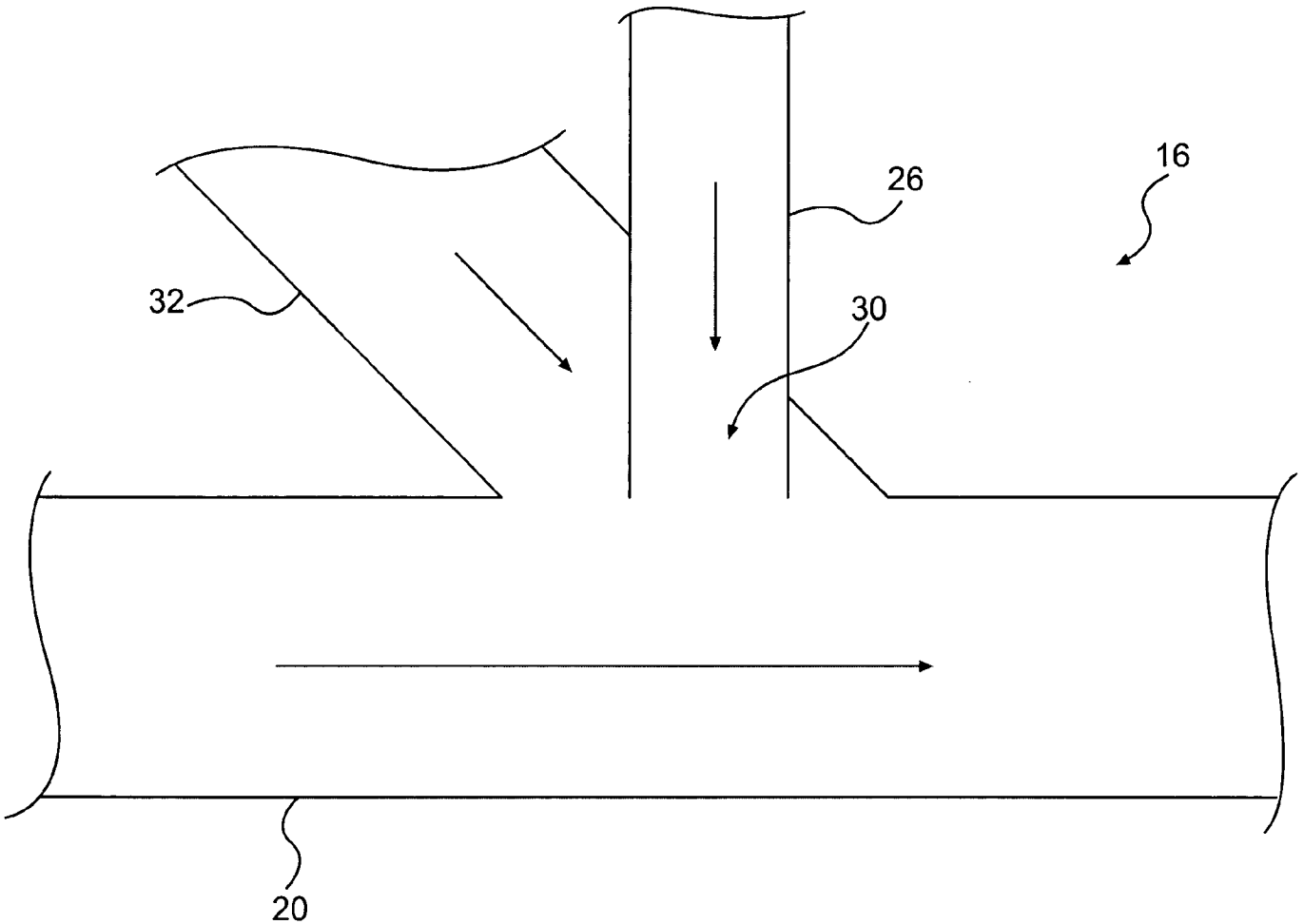
FIG. 2 is a schematic representation of an exhaust-treatment system, according to an exemplary disclosed embodiment.

FIG. 2 is a schematic representation of exhaust-treatment system 16, according to an exemplary disclosed embodiment. In some embodiments, air-line 32 and recirculation loop 26 are fluidly connected to exhaust passage 20. Specifically, air-line 32, recirculation loop 26, and/or exhaust passage 20 may be each positioned and/or configured to permit exhaust gas flow through recirculation loop 26. As shown, air-line 32 may direct a fluid flow past exit aperture 30 such that exhaust gas can flow through recirculation loop 26. In particular, a local pressure decrease in the vicinity of exit aperture 30 can be achieved with suitable positioning of air-line 32 relative to recirculation loop 26. A fluid flow from air-line 32 can flow by exit aperture 30 to create a local low pressure region in the vicinity of exit aperture 30. Such a local pressure decrease could also be provided by various other configurations of air-line 32, recirculation loop 26, and/or exhaust passage 20.

Figure 3:
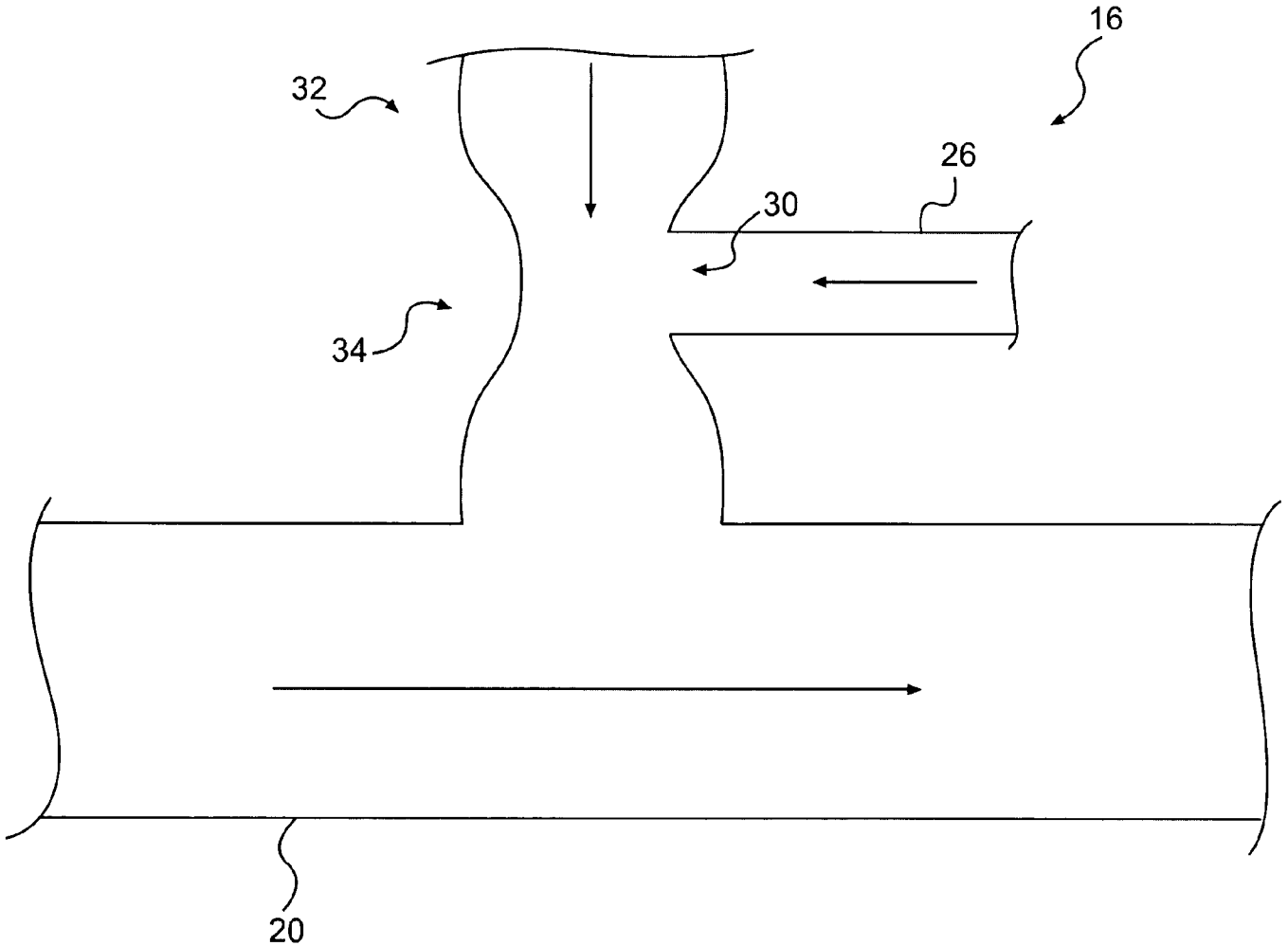
FIG. 3 is a schematic representation of an exhaust-treatment system, according to another exemplary disclosed embodiment.

FIG. 3 is a schematic representation of exhaust-treatment system 16, according to another exemplary disclosed embodiment. As shown, recirculation loop 26 is connected to air-line 32 such that recirculated exhaust gas flowing out of exit aperture 30 can flow into air-line 32. In some embodiments, a region of decreased local pressure in the vicinity of exit aperture 30 can be provided by a venturi 34. As shown in FIG. 3, venturi 34 can be formed in air-line 32, however in other embodiments venturi 34, or a similar device, could be fluidly connected to air-line 32, recirculation loop 26, and/or exhaust passage 20.

Venturi 34 can include any suitably-sized conduit containing a constriction or region of reduced cross-sectional area. Fluid velocity through the constriction increases while pressure decreases, therein creating a partial vacuum via the Bernoulli effect. Locating exit aperture 30 within the vicinity of venturi 34 can decrease fluid pressure within the vicinity of exit aperture 30. A reduced pressure at exit aperture 30 can provide a pressure drop across recirculation loop 26 sufficient to force a flow of exhaust gas through recirculation loop 26.

In some embodiments, recirculation loop 26, input aperture 28, exit aperture 30, exhaust passage 20 and/or catalyst device 22 may be configured to provide a sufficient pressure drop across recirculation loop 26 to permit exhaust gas recirculation. In other embodiments, one or more components of exhaust system 16 may include one or more pumps, compressors or other systems configured to permit exhaust gas recirculation through recirculation loop 26. For example, air-line 32, recirculation loop 26, and/or exhaust passage 20 may include a compressor, turbine, or similar device configured to modify fluid pressure and/or flow. Valves, shunts, coolers, heaters, and/or other devices may also be used to modify exhaust flow as required. For example, various devices and/or systems may permit exhaust gas recirculation through recirculation loop 26 without air-line 32.

INDUSTRIAL APPLICABILITY

The present disclosure provides an exhaust-treatment system configured for filter regeneration. The system may be useful in a variety of exhaust systems for various power sources. Further, the exhaust-treatment system can provide a simple, low cost, and efficient method and system for regenerating filters, such as, for example, diesel particulate filters.

Exhaust-treatment system 16 provides an improved system and method for filter regeneration. Traditional filter regeneration systems often require heating devices, and/or ECU's, sensors, and other components to manage engine operating conditions. Such systems can add cost and complexity, and may reduce specific fuel consumption. The present disclosure can provide a less complicated and less-costly filter regeneration than traditional filter regeneration systems.

Exhaust-treatment system 16 can provide filter regeneration by forming a self-sustaining exothermal reaction within catalyst 22 using recirculated exhaust gas. When filter regeneration is required, fuel may be injected into the exhaust gas upstream of catalyst 22. The fuel may react with the catalyst material via an oxidation reaction that produces heat. The heated exhaust gas flowing into a downstream filter may regenerate the filter, however the exothermal reaction within catalyst 22 must be maintained for long enough to permit sufficient filter regeneration. The exothermal reaction can be "self-sustained" (i.e. additional catalyst heating need not be provided) if the temperature of catalyst 22 can be maintained above the light-off temperature (e.g. about 250° C.). Traditional regeneration systems use heaters, microwave energy, or other heat sources to provide heat to catalyst 22 to maintain sufficient catalyst temperature. The present disclosure uses exhaust gas recirculated from downstream of catalyst 22 to maintain sufficient catalyst temperature.

Recirculation loop 26 can be configured to recirculate a portion of exhaust gas from downstream of catalyst 22 to upstream of catalyst 22, such as, for example, 15%. The recirculated exhaust gas can raise the temperature of exhaust gas entering catalyst 22 as exhaust gas downstream of catalyst 22 can be hotter than exhaust gas upstream of catalyst 22 due to the exothermic reaction within catalyst 22. The combined exhaust gas entering catalyst 22 may be hot enough to provide sufficient energy to maintain the catalyst temperature above the light-off temperature at which fuel is spontaneously oxidized, forming a self-sustaining exothermal reaction.

A typical light-off temperature for a standard oxidation catalyst is about 250° C., although some catalysts can be configured with lower light-off temperatures of, for example, about 220° C. Typical exhaust gas temperatures upstream of catalyst 22 can be about 200° C., and an exothermic reaction can raise exhaust gas temperatures downstream of catalyst 22 to about 650° C. Combining about 15% recirculated exhaust gas at about 650° C. with about 85% exhaust gas at about 200° C. can raise the temperature of exhaust gas entering catalyst 22 to above 250° C. Catalyst 22 may be maintained at other temperatures using suitable portions of recirculated and non-recirculated exhaust gas. Such temperatures can be determined using enthalpy equations representing the heat contributions of the combined gas flows. Various conduit diameters and/or configurations can create suitable recirculation rates for various engine types and/or operating conditions.

Recirculation loop 26 may operate due to a pressure drop across recirculation loop 26, wherein a fluid pressure within the vicinity of exit aperture 30 is lower than a fluid pressure within recirculation loop 26. Such a pressure drop may be formed by suitable configuration of air-line 32, recirculation loop 26, and/or exhaust passage 20. For example, air-line 32 may be positioned or configured such that fluid flow from intake manifold 18 can lower fluid pressure at exit aperture 30. In addition, air-line 32, recirculation loop 26, and/or exhaust passage 20 can include one or more compressors, pumps, valves, or similar devices to permit flow of recirculation exhaust gas.

It will be apparent to those skilled in the art that various modifications and variations can be made in the disclosed systems and methods without departing from the scope of the disclosure. Other embodiments of the disclosed systems and methods will be apparent to those skilled in the art from consideration of the specification and practice of the embodiments disclosed herein. It is intended that the specification and examples be considered as exemplary only, with a true scope of the disclosure being indicated by the following claims and their equivalents.

What is claimed is:

1. A method of regenerating a particulate filter, comprising:

passing a flow of exhaust gas produced by a power source through an oxidation catalyst;

supplying fuel to the exhaust gas at a location downstream of the power source and upstream of the oxidation catalyst;

directing a portion of the exhaust gas from downstream of the oxidation catalyst into the exhaust gas downstream of the power source and upstream of the oxidation catalyst via a recirculation loop to at least partially heat the exhaust gas and initiate combustion of the fuel that further heats the exhaust gas; and regenerating a particulate filter by passing the further-heated exhaust gas through the particulate filter.

2. The method of claim 1, further including supplying a fluid to the exhaust gas upstream of the oxidation catalyst to create a pressure drop across the recirculation loop.

3. The method of claim 1, wherein the oxidation catalyst includes a diesel oxidation catalyst and the particulate filter includes a diesel particulate filter.

4. An exhaust-treatment system, comprising:

an oxidation catalyst configured to receive exhaust gas produced by a power source and heat exhaust gas flowing through the oxidation catalyst;

a particulate filter configured to receive the heated exhaust gas; and a recirculation loop configured to receive a portion of heated exhaust gas downstream of the oxidation catalyst and deliver the portion of exhaust gas downstream of the power source and upstream of the oxidation catalyst, wherein the recirculation loop is configured to raise a temperature of the oxidation catalyst to above a light-off temperature to enable regeneration of the particulate filter.

5. The exhaust-treatment system of claim 4, wherein the oxidation catalyst includes a diesel oxidation catalyst and the particulate filter includes a diesel particulate filter.

6. The exhaust-treatment system of claim 4, further including a fuel supply configured to supply fuel to the exhaust gas upstream of the oxidation catalyst.

7. The exhaust-treatment system of claim 4, wherein the oxidation catalyst and the particulate filter form a combination device.

8. The exhaust system of claim 4, wherein the recirculation loop is configured to:

recirculate about 15% of a total flow of exhaust gas produced by the power source; and receive exhaust gas having a temperature of about 650° C. and direct the exhaust gas into a flow of exhaust gas having a temperature of about 200° C. to produce a mixture having a temperature of about 250° C. entering the oxidation catalyst.

9. The exhaust-treatment system of claim 4, further including an air-line fluidly connected to the recirculation loop.

10. The exhaust-treatment system of claim 9, wherein the air-line is fluidly connected to at least one of an intake manifold, and an exhaust passage.

11. The exhaust-treatment system of claim 9, wherein the air-line and the recirculation loop are fluidly connected to a venturi.

12. A machine, comprising:

a power source configured to produce exhaust gas; and an exhaust-treatment system, comprising:

a passageway configured to receive exhaust gas from the power source;

an oxidation catalyst disposed within the passageway;

a fuel injector configured to inject fuel into the passageway upstream of the oxidation catalyst to initiate an exothermic reaction that heats exhaust gas flowing through the oxidation catalyst;

a particulate filter located downstream of the oxidation catalyst and configured to receive the heated exhaust gas; and a recirculation loop configured to receive a portion of heated exhaust gas from a location downstream of the oxidation catalyst and upstream of the particulate filter and to deliver the portion of exhaust gas to a location downstream of the power source and upstream of the oxidation catalyst to sustain the exothermic reaction.

13. The machine of claim 12, wherein the oxidation catalyst and the particulate filter form a combination device.

14. The machine of claim 12, wherein the oxidation catalyst includes a diesel oxidation catalyst and the particulate filter includes a diesel particulate filter.

15. The machine of claim 14, wherein the recirculation loop is configured to raise a temperature of the diesel oxidation catalyst to above a light-off temperatures to enable regeneration of the diesel particulate filter.

16. The machine of claim 12, further including an air-line fluidly connected to the recirculation loop.

17. the machine of claim 16, wherein the air-line is fluidly connected to at least one of an intake manifold, and an exhaust passage.

18. The machine of claim 16, wherein the air-line and the recirculation loop are fluidly connected to a venturi.

* * * * *